US007546796B2

(12) United States Patent
Hunn

(10) Patent No.: US 7,546,796 B2
(45) Date of Patent: Jun. 16, 2009

(54) ARMOR AND METHOD OF MAKING SAME

(75) Inventor: David L. Hunn, Kennedale, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 554 days.

(21) Appl. No.: 11/347,526

(22) Filed: Feb. 3, 2006

(65) Prior Publication Data

US 2009/0126557 A1 May 21, 2009

(51) Int. Cl.
*F41H 5/04* (2006.01)

(52) U.S. Cl. ..... 89/36.02; 89/36.08

(58) Field of Classification Search ..... 89/36.01, 89/36.02, 36.05, 36.04, 36.11, 36.08, 36.09; 109/49.5

See application file for complete search history.

(56) References Cited

U.S. PATENT DOCUMENTS 4,836,084 A * 6/1989 Vogelesang et al. ..... 89/36.02
5,763,813 A 6/1998 Cohen et al. ..... 89/36.02
5,972,819 A 10/1999 Cohen ..... 501/127
6,112,635 A 9/2000 Cohen ..... 89/36.02
6,203,908 B1 3/2001 Cohen ..... 428/397
6,289,781 B1 9/2001 Cohen ..... 89/36.02
6,408,734 B1 6/2002 Cohen ..... 89/36.02
6,575,075 B2 6/2003 Cohen ..... 89/36.02
6,860,186 B2 3/2005 Cohen ..... 89/36.02
6,892,623 B2 5/2005 Benyami et al. ..... 89/36.02
6,912,944 B2 * 7/2005 Lucuta et al. ..... 89/36.2
2003/0167910 A1 * 9/2003 Strait ..... 89/36.02

* cited by examiner

*Primary Examiner*—Michael Carone
*Assistant Examiner*—Benjamin P Lee
(74) *Attorney, Agent, or Firm*—Daren C. Davis; James E. Walton

(57) ABSTRACT

An armor includes a face sheet, a spall liner, and a core disposed between the face sheet and the spall liner. The core includes a polymeric matrix and a plurality of ceramic rods disposed in the polymeric matrix. The armor further includes a first shock dissipation layer disposed between the face sheet and the core. The armor optionally includes a second shock dissipation layer disposed between the spall liner and the core.

20 Claims, 6 Drawing Sheets

ARMOR AND METHOD OF MAKING SAME

BACKGROUND

1. Field of the Invention

The present invention relates to armor.

2. Description of Related Art

In combat situations, such as in military, police, and/or armored transport operations, it is desirable to protect vehicles, such as tanks, personnel carriers, trucks, and the like, as well as the vehicle's contents from damage by enemy fire. Accordingly, such vehicles are known to have armor to reduce the likelihood that ballistic rounds or other such projectiles will penetrate the vehicle. If the rounds penetrate the vehicle, the occupants of the vehicle may be injured or the vehicle's ability to operate may be impaired. It may also be desirable for the armor to be able to survive multiple rounds striking the armor in close proximity to one another, so that the integrity of the vehicle is not compromised or is only minimally compromised. Moreover, it is generally desirable for armor to include a relatively hard outer layer that the round encounters first. The hard outer layer starts the projectile or round defeat sequence by increasing the projectile dwell time on the armor, thus slowing the projectile down, or by blunting or fracturing the projectile early in the penetration event.

While protecting the vehicle and its occupants is generally of primary importance, other factors may play a role in the design of armor for the vehicle. It is desirable for the vehicle to be as lightweight as possible. Generally, a vehicle's fuel consumption increases as the vehicle's weight increases. A heavier vehicle usually requires a heavier drive train than a lighter vehicle, which further increases weight. Increased weight may also reduce the mobility of the vehicle and, thus, reduce the utility of the vehicle in combat. As the weight of the vehicle's armor contributes to the overall weight of the vehicle, it is desirable for the vehicle's armor to be as lightweight as possible. Many known armor systems, while protecting the vehicle from ballistic damage, add significant weight to the vehicle and provide little or no additional structural strength to the vehicle.

It is also not desirable for the vehicle's armor to greatly increase the overall size of the vehicle (e.g., the vehicle's height, width, length, volume, and the like), so that existing transportation equipment (e.g., trucks, trailers, aircraft, and the like) are capable of transporting the vehicle. If the size of the vehicle is increased over previous vehicles, the existing transportation equipment may not be capable of transporting the vehicle, or the existing transportation equipment may be limited to carrying fewer vehicles per load. Additionally, it is desirable to maximize the internal volume of the vehicle to allow adequate space to house the crew and crew gear. Accordingly, armor having lower volumes generally result in vehicle designs having larger internal volumes. The overall size of the vehicle is also a factor in combat situations. Generally, smaller targets (i.e., smaller vehicles) are more difficult to hit with artillery, such as rockets, mortars, missiles, and the like. Thus, it is desirable for the vehicle's overall size to be smaller, rather than larger, to reduce the likelihood of an artillery hit.

It is also desirable that the vehicle's armor be durable. During combat and during travel between combat locations, the vehicle may encounter flying rocks, debris, shrapnel, and the like. If the armor is overly thin or brittle, it may not be capable of surviving impacts from such sources.

Cost is also a consideration in vehicle armor. Armor that uses exotic materials (e.g., laminated ceramics of boron carbide, silicon carbide, alumina, and the like), or armor that has many components in difficult-to-produce configurations, may be quite effective in combat but may be unaffordable.

There are many designs of materials that are useful as armors and that are well known in the art; however, considerable shortcomings remain.

SUMMARY OF THE INVENTION

There is a need for an improved armor.

Therefore, it is an object of the present invention to provide an improved armor and a method of making the armor.

These and other objects are achieved by providing an armor that includes a face sheet, a spall liner, and a core disposed between the face sheet and the spall liner. The core includes a polymeric matrix and a plurality of ceramic rods disposed in the polymeric matrix. The armor further includes a first shock dissipation layer disposed between the face sheet and the core.

In another aspect, the present invention provides an armor, including a face sheet, a spall liner, and a core disposed between the face sheet and the spall liner. The core includes a polymeric matrix and a plurality of ceramic rods disposed in the polymeric matrix, wherein the plurality of ceramic rods exhibits an average height. The armor further includes a first, viscoelastic, shock dissipation layer disposed between the face sheet and the core, the first shock dissipation layer exhibiting a thickness of no more than about one-half of the average height of the plurality of ceramic rods. Moreover, the armor includes a second, viscoelastic, shock dissipation layer disposed between the spall liner and the core, the second shock dissipation layer exhibiting a thickness of no more than about one-half of the average height of the plurality of ceramic rods.

In yet another aspect of the present invention, a method is provided including the steps of providing a plurality of ceramic rods in a desired configuration, a face sheet, a first shock dissipation layer, and a spall liner; embedding the plurality of ceramic rods in a polymeric matrix to form a core having a first surface and a second surface opposing the first surface of the core; and disposing the first shock dissipation layer between the face sheet and the first surface of the core. The method further includes the step of disposing the spall liner proximate the second surface of the core to form an armor.

The present invention provides significant advantages, including: (1) providing an armor capable of withstanding multiple strikes from ballistic projectiles in a small area; (2) providing an armor that has a lower areal weight than conventional armors; and (3) providing an armor that is less expensive to produce than conventional armors.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote (s) the first figure in which the respective reference numerals appear, wherein:

Figure 1:
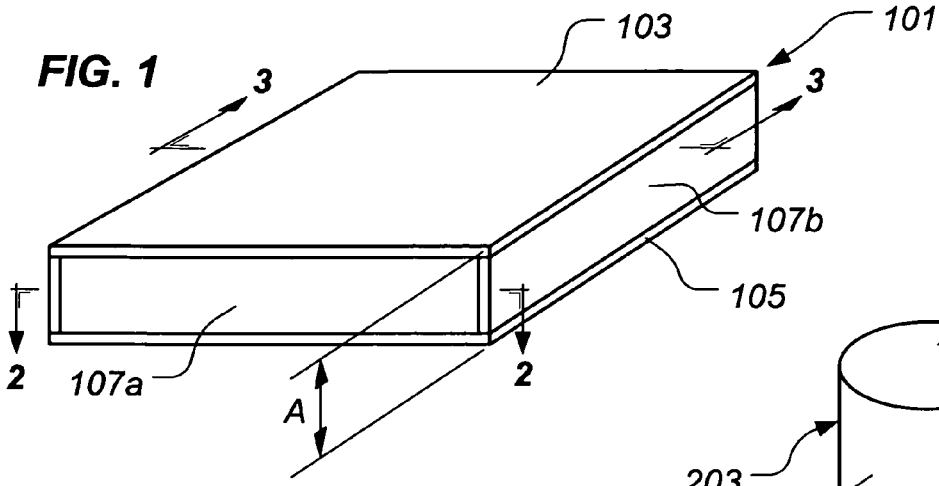
FIG. 1 is a stylized, perspective view of an illustrative implementation of an armor according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

It should be appreciated that the following terms and phrases are intended to have a particular meaning throughout the following detailed description. The term "ceramic" refers to an inorganic, non-metallic material whose formation is due to the action of heat. The term "rod" means a three-dimensional, solid cylinder. The term "cylinder" refers to a solid having a surface created by projecting a closed two-dimensional curve along an axis that is not on or parallel to the plane of the curve. In a circular cylinder, the curve is a circle. In a right, circular cylinder, the curve is a circle and the plane of the circle is substantially perpendicular to the axis along which the circle is projected. In a octagonal cylinder, the curve is a hexagon. In a right, octagonal cylinder, the curve is a hexagon and the plane of the hexagon is substantially perpendicular to is substantially perpendicular to the axis along which the hexagon is projected.

Moreover, a "viscoelastic material" is a material that exhibits both elastic and viscous properties that are demonstrable in response to mechanical shear. "Vehicles" are devices, apparatuses, or the like that travel through a medium, such as air or water. Examples of vehicles include, but are not limited to, missiles, rockets, torpedoes, airplanes, helicopters, automobiles, trucks, military tanks, and drones. "Spall" refers to fragments broken from either a barrier (e.g., fragments broken from an armor as the result of penetration or the impact of a projectile) or from a projectile that has impacted the barrier. The term "simple contour," as it relates to surfaces or shapes, is a surface that is curved in one direction. The term "complex contour" as it relates to surfaces or shapes, is a surface or shape that is contoured in at least two directions. The term "gradient" means rising or falling by regular degrees of inclination. The term "hexagonal-close-packed" means an arrangement wherein a central element is surrounded by six adjacent elements, such that the arrangement occupies a minimum amount of space.

The present invention represents an armor for lessening the destructive effects of ballistic projectiles, such as bullets. Generally, the armor of the present invention comprises a core including plurality of ceramic rods disposed in a polymeric matrix. An elastomeric layer is disposed between the core and a face sheet. A spall liner is disposed on a side of the core opposite that of the elastomeric layer. In use, the armor is oriented such that ballistic projectiles will preferably encounter the face sheet first.

FIG. 1 depicts a perspective view of one particular implementation of the present invention. It should be noted, however, that the various embodiments of the present invention may take on many different forms and implementations. An armor 101 comprises a core disposed between a face sheet 103 and a spall liner 105. Various embodiments of the core are illustrated in FIGS. 2-8. In the implementation illustrated in FIG. 1, armor 101 further comprises edge close-outs 107*a*-107*d* (note that edge close-outs 107*c* and 107*d* are not shown in FIG. 1 but are illustrated in FIGS. 2 and 7-10). In other implementations, however, edge close-outs 107*a*-107*d* may be omitted or may take on other forms.

While armor 101 is illustrated as being substantially flat in shape, the present invention contemplates other shapes, such as shapes having simple or complex contours. Moreover, an armor of the present invention may be generally rectangular, as illustrated herein, or may define any other desired, suitable shape for the particular implementation of the armor. Furthermore, while armor 101 of FIG. 1 is depicted as having a substantially constant thickness A, the present invention contemplates embodiments wherein the thickness of the armor is not constant. In such embodiments, armor according to the present invention may exhibit a plurality of discrete thicknesses and/or the armor may exhibit one or more thickness gradients.

Preferably, face sheet 103 comprises a material that will, to some degree, impede the progress of a ballistic projectile. For example, in various embodiments, face sheet 103 comprises titanium; a titanium alloy; aluminum; an aluminum alloy; an organic-matrix composite material, such as, for example, graphite-, carbon-, or fiberglass-reinforced epoxy composite material; a metal-matrix composite material, such as carbon-, silicon carbide-, or boron-reinforced titanium or aluminum composite material; a laminated material, such as titanium/aluminum laminate; or the like. Preferably, face sheet 103 comprises titanium; a titanium alloy; aluminum; an aluminum alloy; an organic-matrix composite material, such as, for example, graphite-, carbon-, or fiberglass-reinforced epoxy composite material; a laminated material, such as titanium/aluminum laminate; or the like.

Preferably spall liner 105 comprises a material that will drastically reduce the velocity of spall (e.g., projectile fragments or fragments of armor 101) exiting armor 101. More preferably, spall liner 105 comprises a material that will substantially prevent the spall from exiting the armor 101. For example, in various embodiments, spall liner 105 comprises one of the materials disclosed above as comprising face sheet 103. Preferably, spall liner 105 comprises titanium; a titanium alloy; aluminum; an aluminum alloy; an organic-matrix composite material, such as, for example, graphite-, carbon-, or fiberglass-reinforced epoxy composite material; a laminated material, such as titanium/aluminum laminate; or the like. It should be noted, however, that the particular compositions of face sheet 103 and spall liner 105 are implementation specific. Accordingly, the present invention contemplates faces sheets (e.g., face sheet 103) and spall liners (e.g. spall liner 105) comprising any material suitable for a particular implementation.

Figure 3:
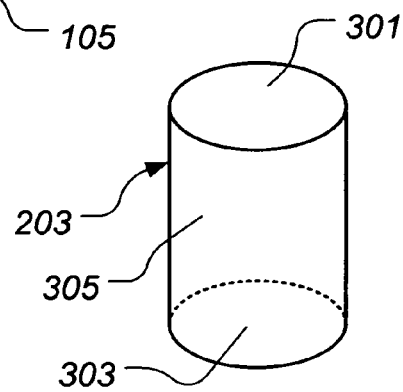
FIG. 3 is a perspective view of an illustrative embodiment of a ceramic rod according to the present invention.
Figure 2:
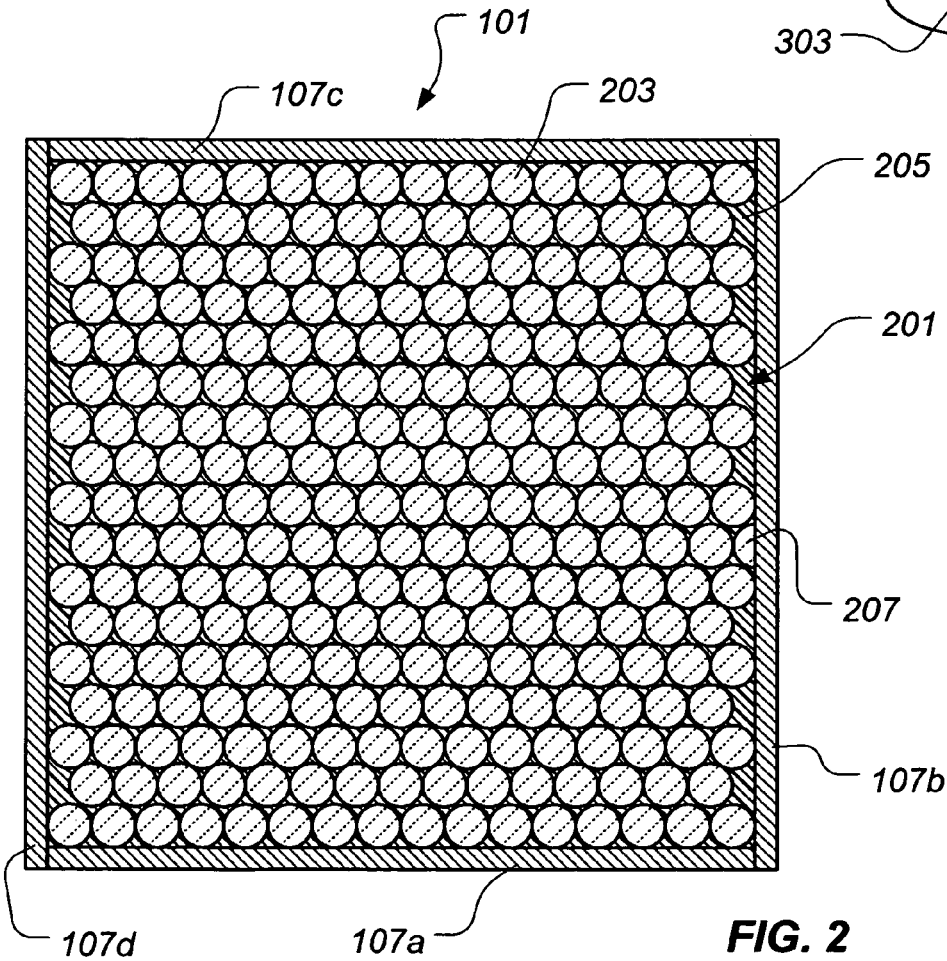
FIG. 2 is a cross-sectional view of the armor of FIG. 1, taken along the line 2-2 of FIG. 1, depicting a first illustrative embodiment of the present invention.

Referring now to FIG. 2, a first illustrative embodiment of a core 201 according to the present invention is depicted. Core 201 comprises a plurality of ceramic rods 203 (only one indicated for clarity) disposed in a cured, polymeric matrix 205. Exemplary materials for polymeric matrix 205 include, but are not limited to, polyurethane and epoxy. FIG. 3 illustrates one of the plurality of ceramic rods 203. In this embodiment, each of the plurality of ceramic rods 203 is right, circular cylindrical in shape, comprising a first end surface 301 and a second end surface 303. The scope of the present invention, however, is not so limited, as will be more fully discussed below. Ceramic rods 203 may comprise various ceramic materials, even within the same armor 101. Such ceramic material include, but are not limited to aluminum oxide, silicon carbide, boron carbide, or the like. Preferably, ceramic rods 203 comprise aluminum oxide because ceramic rods 203 comprising aluminum oxide generally have a lower cost than ceramic rods 203 comprising other ceramic materials.

Referring again to FIG. 2, ceramic rods 203 are preferably arranged in a hexagonal-close-packed configuration to obtain maximum ceramic rod density of core 201. In such an embodiment, adjacent ceramic rods 203 abut one another and polymeric matrix 205 substantially fills interstices between adjacent ceramic rods 203. In one embodiment, one or more partial, cylindrical, ceramic rods 207 may be included in core 201 to further enhance the ceramic rod areal density of core 201.

Figure 4:
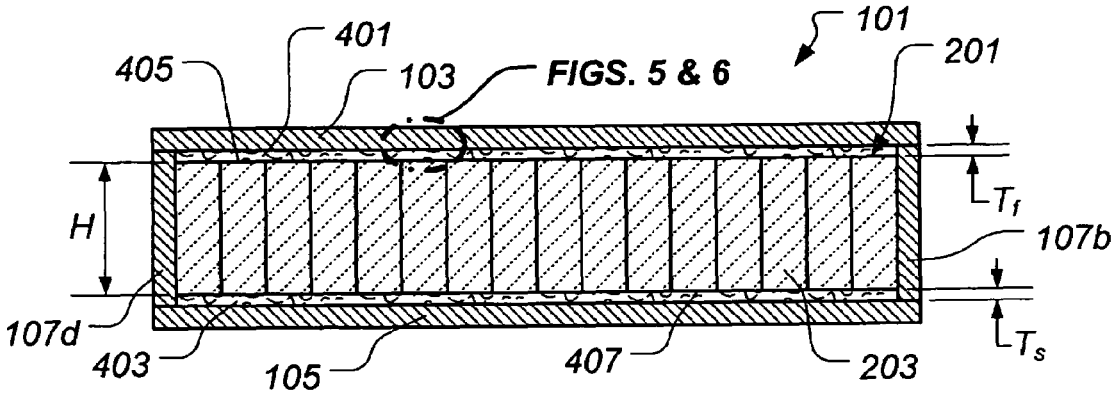
FIG. 4 is a cross-sectional view of the armor of FIG. 1, taken along the line 3-3 of FIG. 1, depicting the illustrative embodiment of FIG. 2.

Turning now to FIG. 4, armor 101 further comprises a first shock dissipation layer 401 disposed between face sheet 103 and the plurality of ceramic rods 203. Preferably, armor 101 comprises a second shock dissipation layer 403 disposed between spall liner 105 and the plurality of ceramic rods 203, but the present invention is not so limited. In preferred embodiments, shock dissipation layers 401 and 403 comprise a viscoelastic material, such as, for example, polyurethane, polysulfide polymer, natural rubber, a synthetic rubber, or the like, or a combination of such materials. Preferably, a thickness $T_f$ of first shock dissipation layer 401 and a thickness $T_s$ of second shock dissipation layer 403, if second shock dissipation layer 403 is present, is no more than about one-half of an average height H of ceramic rods 203. The scope of the present invention, however, is not so limited, as other relationships between thicknesses $T_f$, $T_s$ and height H may be desired in certain implementations.

Figure 5:
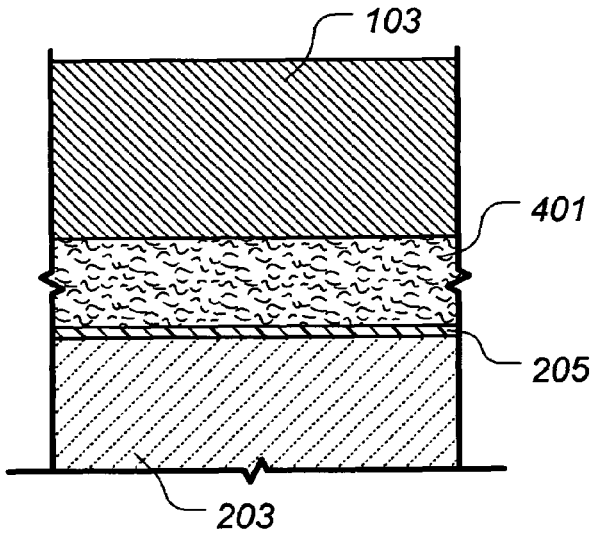
FIG. 5 is an enlarged, cross-sectional view of a first illustrative embodiment of a portion of the armor of FIG. 3.
Figure 6:
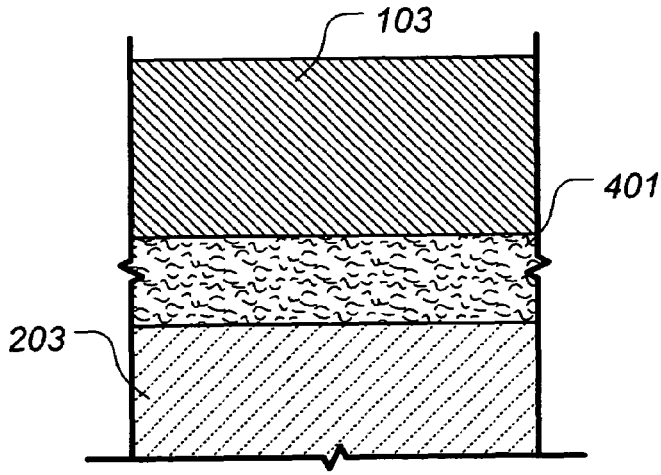
FIG. 6 is an enlarged, cross-sectional view of a second illustrative embodiment of a portion of the armor of FIG. 3.

FIGS. 5 and 6 depict two particular, illustrative embodiments of an interface between shock dissipation layer 401 and one of the plurality of ceramic rods 203, as indicated in FIG. 4. In the particular embodiment illustrated in FIG. 5, a thin layer of polymeric matrix 205 is disposed between ceramic rod 203 and first shock dissipation layer 401. Such a configuration is produced when at least one of the plurality of ceramic rods 203 (shown in FIGS. 3 and 4) is substantially encapsulated by polymeric matrix 205. Alternatively, as illustrated in FIG. 6, ceramic rod 203 may directly abut first dissipation layer 401, omitting substantially any polymeric matrix 205 therebetween. Such a configuration is produced when polymeric matrix 205 is disposed about a side wall 305 (see FIG. 3) of ceramic rod 203, but first end 301 and second end 303 of ceramic rod 203 are exposed from polymeric matrix 205.

Figure 7:
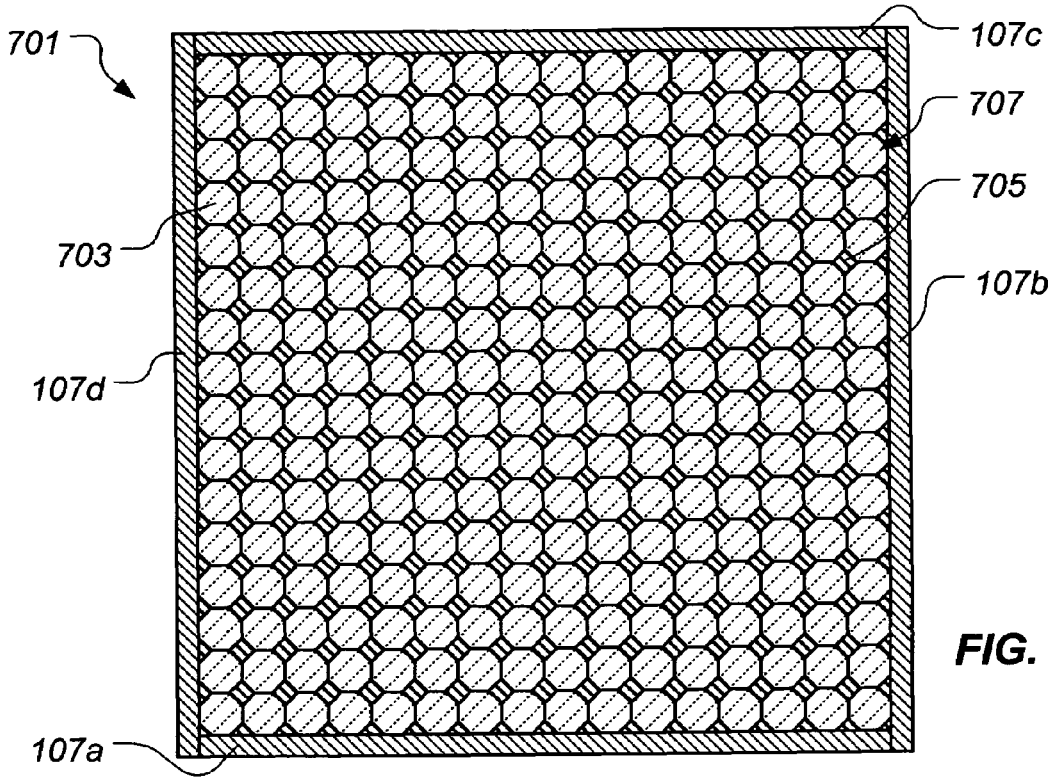
FIG. 7 is a cross-sectional view of a second illustrative embodiment of an armor according to the present invention, corresponding to the view shown in FIG. 2.
Figure 8:
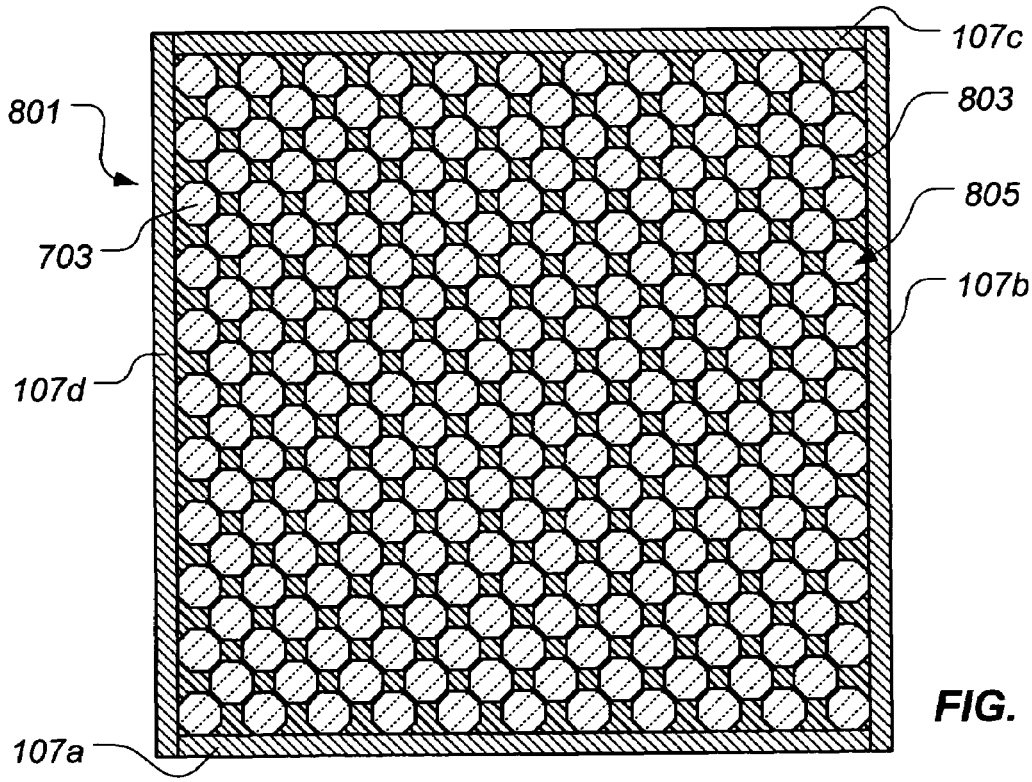
FIG. 8 is a cross-sectional view of a third illustrative embodiment of an armor according to the present invention, corresponding to the view shown in FIG. 2.

While, in a preferred embodiment, ceramic rods 203 are right, circular cylindrical in shape, the scope of the present invention is not so limited. Rather, as depicted in FIGS. 7-10, ceramic rods of the present invention may exhibit other shapes. For example, as shown in FIGS. 7 and 8, illustrative embodiments of armors 701 and 801 according to the present invention comprise a plurality of ceramic rods 703 (only one indicated for clarity), having right, octagonal cylindrical shapes. It should be noted that the views depicted in FIGS. 7 and 8 correspond to the view shown in FIG. 2. In the illustrative embodiment of FIG. 7, ceramic rods 703 are arranged to have a greater areal density than in the illustrative embodiment of FIG. 8. In the embodiment of FIG. 7, the plurality of ceramic rods 703 are disposed in a polymeric matrix 705, thus forming a core 707, as discussed above concerning the embodiment of FIGS. 2 and 4. In the embodiment of FIG. 8, the plurality of ceramic rods 703 are disposed in a polymeric matrix 803, forming a core 805 corresponding to core 201 of FIGS. 2 and 4. Other aspects of the embodiments illustrated in FIGS. 7 and 8 generally correspond to the aspects of the embodiments of FIGS. 2-6.

Figure 9:
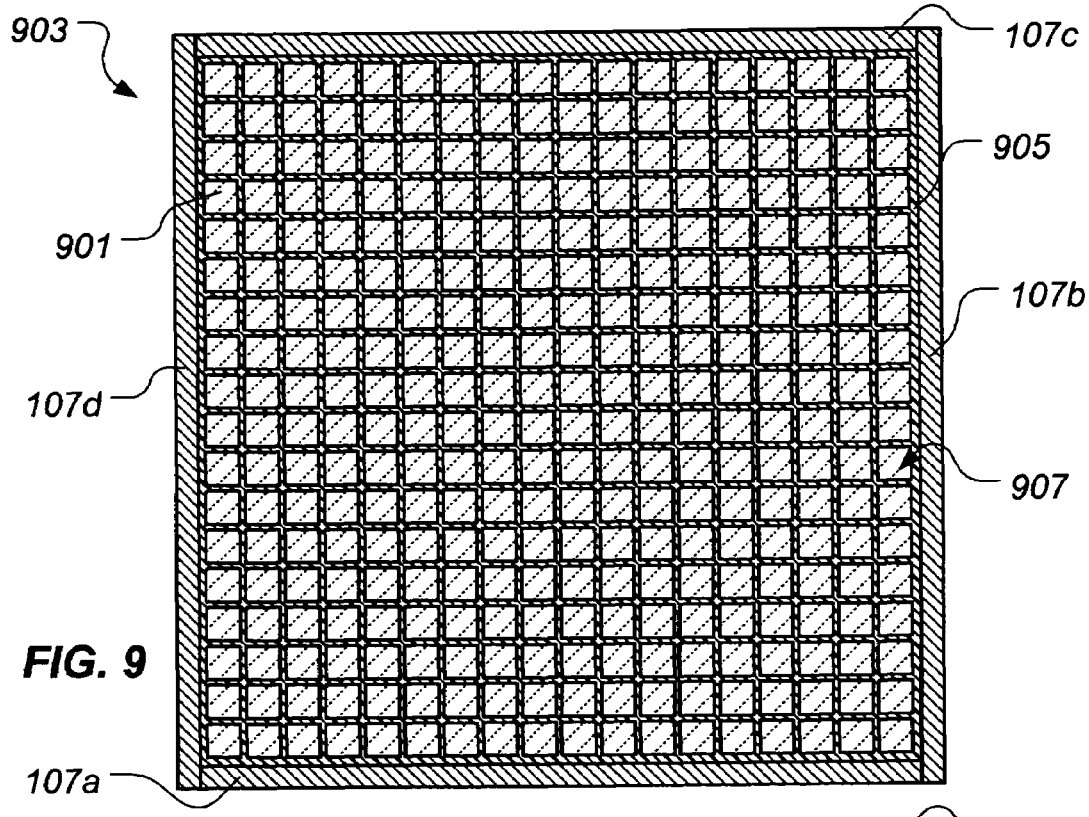
FIG. 9 is a cross-sectional view of a fourth illustrative embodiment of an armor according to the present invention, corresponding to the view shown in FIG. 2.
Figure 10:
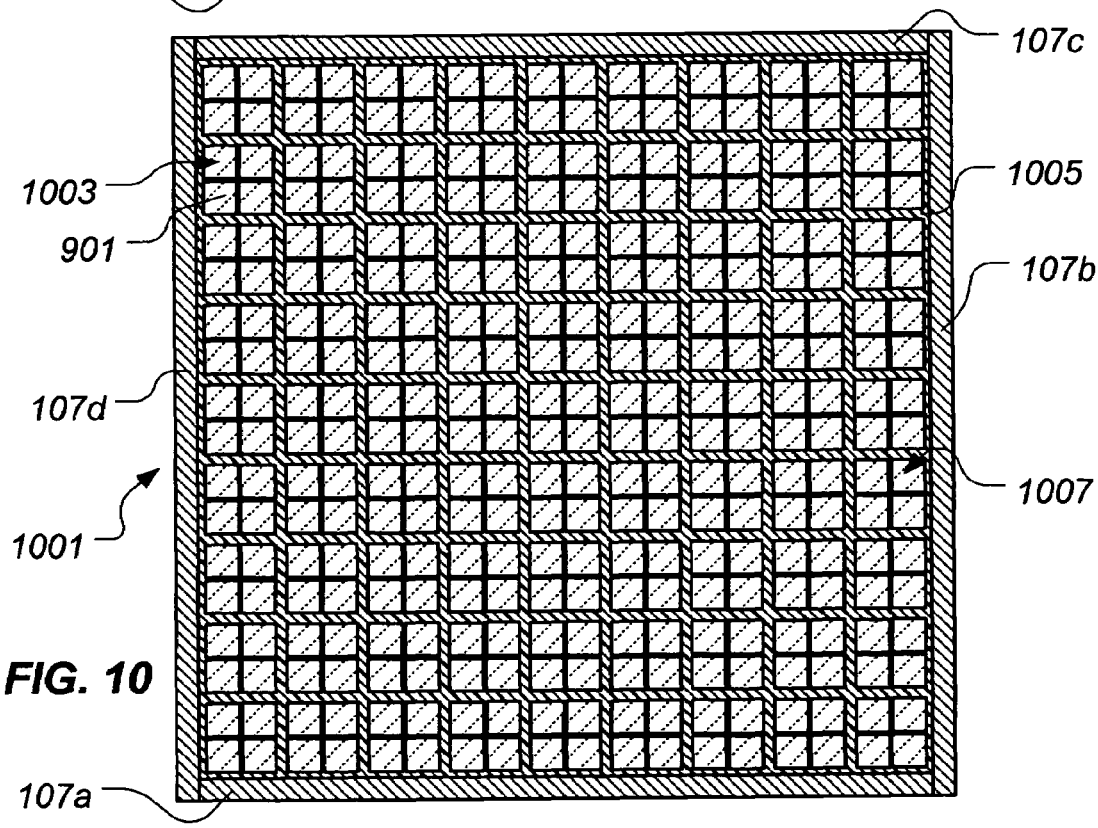
FIG. 10 is a cross-sectional view of a fifth illustrative embodiment of an armor according to the present invention, corresponding to the view shown in FIG. 2.

Alternatively, as illustrated in FIGS. 9 and 10, ceramic rods 901 (only one indicated for clarity) of armor 903 and 1001 of the present invention may exhibit right, rectangular cylindrical shapes. It should be noted that the views depicted in FIGS. 9 and 10 also correspond to the view shown in FIG. 2. In the particular embodiment of FIG. 9, a polymeric matrix 905 is disposed around each ceramic rod 901 to form a core 907. In the embodiment of FIG. 10, some adjacent ceramic rods 901 abut one another to form a group 1003 (only one indicated for clarity) of ceramic rods 901. A polymeric matrix 1005 is disposed around each group 1003 of ceramic rods 901 to form a core 1007. It will be appreciated, however, that other configurations are possible and those configurations are contemplated by the present invention. For example, in the embodiment illustrated in FIG. 10, a group 1003 of ceramic rods 901 comprises four ceramic rods 901. Other embodiments of armor according to the present invention, however, may include groups of two or more ceramic rods (e.g., ceramic rods 901).

It should be noted that the particular configurations of the armor of the present invention that are disclosed herein and illustrated in the drawings are merely exemplary. The particular configuration of the armor of the present invention is implementation specific and, therefore, may take on many different forms. For example, particular elements of the armor of the present invention, as well as the armor itself, may exhibit different size and/or geometrical relationships than those illustrated herein. In such embodiments, for example, right cylindrical, ceramic rods 201, 703, and/or 901 may be merely cylindrical in shape. Thus, for example in embodiments wherein the armor of the present invention exhibits a thickness gradient, ceramic rods 203 (best shown in FIG. 3) may be replaced with ceramic rods having one or more ends that are not substantially perpendicular to a side wall thereof.

The armor of the present invention, however, comprises a core disposed between a shock dissipation layer and a spall liner. The shock dissipation layer is disposed between the core and a face sheet. The core comprises a plurality of ceramic rods disposed in a polymeric matrix. In one embodiment, a second shock dissipation layer is disposed between the core and the spall liner. The face sheet, shock dissipation layers, core, and spall liner may be held in assembly by any suitable means, such as, for example, mechanical fastening means, adhesives, or the like.

It should be noted that the armor (e.g., armor 101, 701, 801, 903, 1001, or the like) of the present invention may comprise a portion of or be attached to a vehicle, such as, for example, a tank, a personnel carrier, a truck, or the like. In one particular operation of the present invention, a ballistic projectile striking face sheet 103 is somewhat blunted and the shock associated with the ballistic projectile striking face sheet 103 is dissipated or attenuated to a degree by first shock dissipation layer 401. In many instances, the ballistic projectile passes through face sheet 103 and first shock dissipation layer 401, striking core 201, 707, 805, 907, or 1007. Upon striking one or more ceramic rods 203, 703, or 901, the one or more the ballistic projectile is further blunted or fragmented. The one or more ceramic rods 203, 703, or 901 are likely also fragmented or shattered; however, polymeric matrix 205, 705, 803, 905, or 1005 aids in decreasing the velocity of ballistic projectile fragments and ceramic rod fragments, which are retained in armor 101, 701, 801, 903, or 1001 by spall liner 105 and edge close-outs, such as edge close-outs 107*a*-107*d* or the like. In some situations, polymeric matrix 205, 705, 803, 905, or 1005 also aids in dissipating the impact of the ballistic projectile and/or fragments thereof. It should be noted that the armor of the present invention is capable of withstanding multiple ballistic projectile strikes in a local area.

Figure 11:
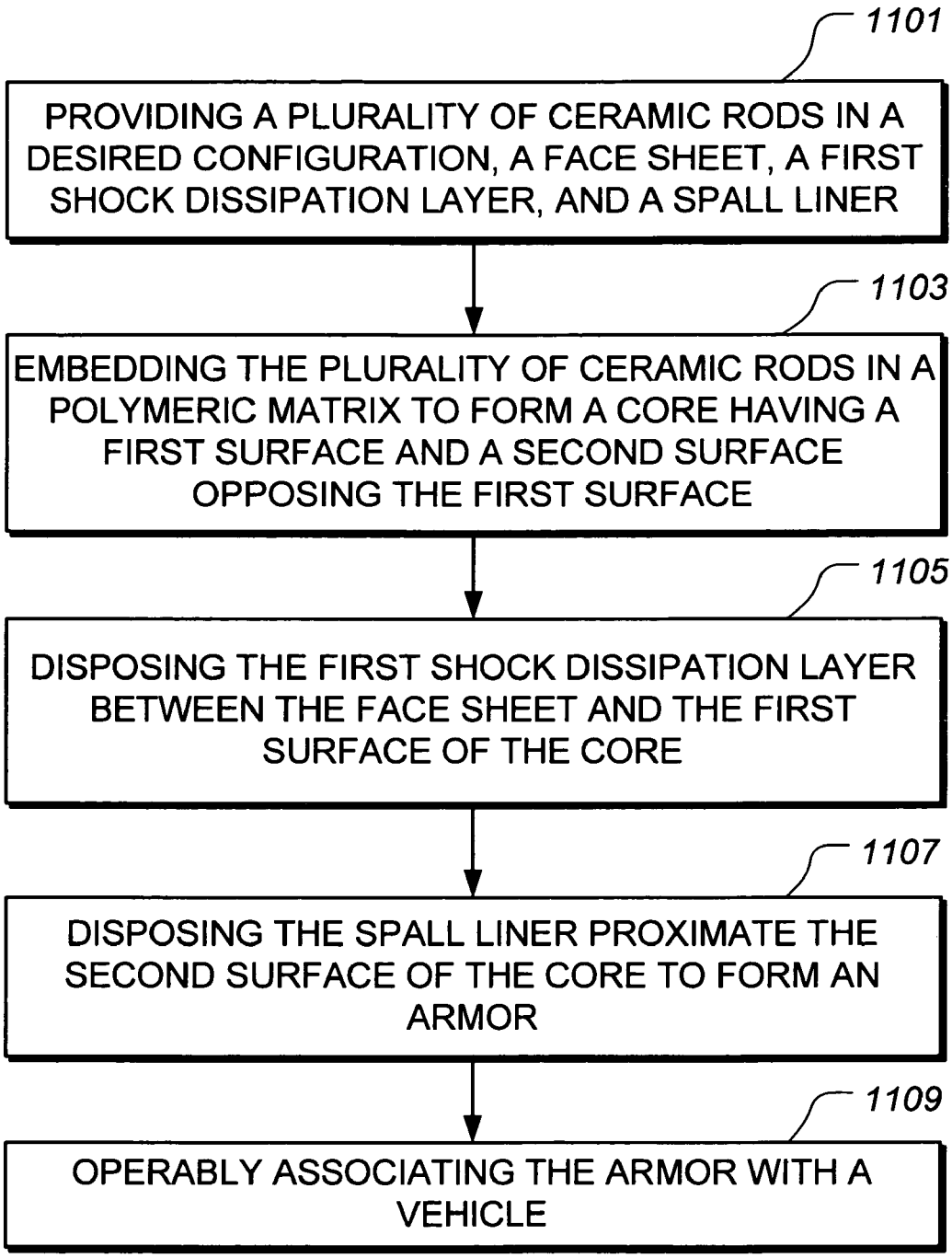
FIG. 11 is a flow chart representing a first illustrative embodiment of a method according to the present invention.

FIG. 11 depicts a first illustrative embodiment of a method of the present invention. In the illustrated embodiment, the method includes the step of providing a plurality of ceramic rods (e.g., ceramic rods 203, 703, 901, or the like) in a desired configuration, a face sheet (e.g., face sheet 103 or the like), a first shock dissipation layer (e.g., first shock dissipation layer 401 or the like), and a spall liner (e.g., spall liner 105 or the like), depicted as block 1101. The method further includes the step of embedding the plurality of ceramic rods in a polymeric matrix (e.g., polymeric matrix 205, 705, 803, 905, 1005, or the like) to form a core (e.g., core 201, 707, 805, 907, 1007, or the like) having a first surface (e.g., a first surface 405 of FIG. 4) and a second surface (e.g., a second surface 407 of FIG. 4) opposing the first surface of the core, depicted as block 1103. The method further includes the step of disposing the first shock dissipation layer between the face sheet and the first surface of the core (block 1105) and disposing the spall liner proximate the second surface of the core to form an armor (e.g., armor 101, 701, 801, 903, 1001, or the like), depicted as block 1107. In one embodiment, the method further comprises the step of operably associating the armor with a vehicle (block 1109).

Figure 12:
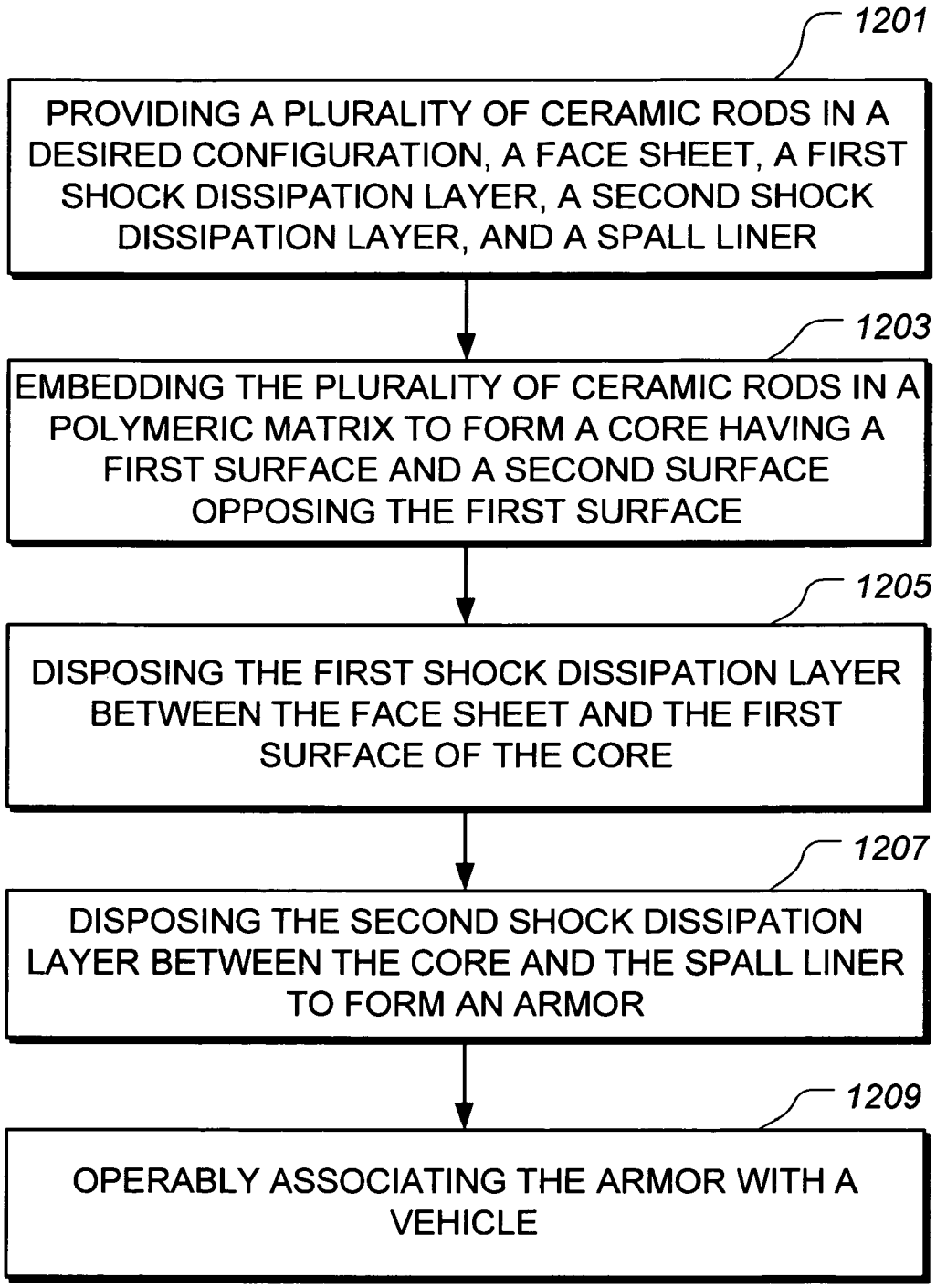
FIG. 12 is a flow chart representing a second illustrative embodiment of a method according to the present invention.

FIG. 12 depicts a second illustrative embodiment of a method of the present invention. In the illustrated embodiment, the method includes the step of providing a plurality of ceramic rods (e.g., ceramic rods 203, 703, 901, or the like) in a desired configuration, a face sheet (e.g., face sheet 103 or the like), a first shock dissipation layer (e.g., first shock dissipation layer 401 or the like), a second shock dissipation layer (e.g., second shock dissipation layer 403 or the like) and a spall liner (e.g., spall liner 105 or the like), depicted as block 1201. The method further includes the step of embedding the plurality of ceramic rods in a polymeric matrix (e.g., polymeric matrix 205, 705, 803, 905, 1005, or the like) to form a core (e.g., core 201, 707, 805, 907, 1007, or the like) having a first surface (e.g., a first surface 405 of FIG. 4) and a second surface (e.g., a second surface 407 of FIG. 4) opposing the first surface of the core, depicted as block 1203. The method further includes the step of disposing the first shock dissipation layer between the face sheet and the first surface of the core (block 1205) and disposing the second shock dissipation layer between the core and the spall liner to form an armor (e.g., armor 101, 701, 801, 903, 1001, or the like), depicted as block 1207. In one embodiment, the method further comprises the step of operably associating the armor with a vehicle, depicted as block 1209.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An armor, comprising:

a projectile entry sheet;

a spall liner;

a core disposed between the projectile entry sheet and the spall liner, the core comprising:

a polymeric matrix; and a plurality of ceramic rods disposed in the polymeric matrix; and a first shock dissipation layer disposed between the projectile entry sheet and the core.

2. The armor, according to claim 1, wherein the projectile entry sheet comprises:

a material selected from the group consisting of titanium; a titanium alloy; aluminum; an aluminum alloy; an organic-matrix composite material; a metal-matrix composite material; a laminated material; and a titanium/aluminum laminate.

3. The armor, according to claim 1, wherein the polymeric matrix extends between at least one ceramic rod of the plurality of ceramic rods and the first shock dissipation layer.

4. The armor, according to claim 1, wherein at least one ceramic rod of the plurality of ceramic rods abuts the first shock dissipation layer.

5. The armor, according to claim 1, wherein the polymeric matrix comprises:

a material selected from the group consisting of polyurethane and epoxy.

6. The armor, according to claim 1, wherein at least one of the plurality of ceramic rods comprises:

a material selected from the group consisting of aluminum oxide, silicon carbide, and boron carbide.

7. The armor, according to claim 1, wherein at least some of adjacent ceramic rods of the plurality of ceramic rods abut one another.

8. The armor, according to claim 1, wherein the spall liner comprises:

a material selected from the group consisting of titanium; a titanium alloy; aluminum; an aluminum alloy; an organic-matrix composite material; a metal-matrix composite material; a laminated material; and a titanium/aluminum laminate.

9. The armor, according to claim 1, wherein the first shock dissipation layer comprises:

a viscoelastic material.

10. The armor, according to claim 1, wherein the first shock dissipation layer comprises:

a material selected from the group consisting of polyurethane, polysulfide polymer, natural rubber, and a synthetic rubber.

11. The armor, according to claim 1, further comprising:

a second shock dissipation layer disposed between the core and the spall liner.

12. The armor, according to claim 11, wherein the second shock dissipation layer comprises:

a material selected from the group consisting of polyurethane, polysulfide polymer, natural rubber, and a synthetic rubber.

13. The armor, according to claim 11, wherein a thickness of the second shock dissipation layer is no more than about one-half of an average height of the plurality of ceramic rods.

14. The armor, according to claim 1, wherein a thickness of the first shock dissipation layer is no more than about one-half of a height of an average height of the plurality of ceramic rods.

15. The armor, according to claim 1, wherein the armor is operably associated with a vehicle.

16. The armor, according to claim 1, wherein the armor is configured to form a portion of a vehicle.

17. An armor, comprising:

a projectile entry sheet;

a spall liner;

a core disposed between the projectile entry sheet and the spall liner, the core comprising:

a polymeric matrix; and a plurality of ceramic rods disposed in the polymeric matrix, the plurality of ceramic rods exhibiting an average height;

a first, viscoelastic, shock dissipation layer disposed between the projectile entry sheet and the core, the first shock dissipation layer exhibiting a thickness of no more than about one-half of the average height of the plurality of ceramic rods; and a second, viscoelastic, shock dissipation layer disposed between the spall liner and the core, the second shock dissipation layer exhibiting a thickness of no more than about one-half of the average height of the plurality of ceramic rods.

18. A method, comprising the steps of:

providing a plurality of ceramic rods in a desired configuration;

embedding the plurality of ceramic rods in a polymeric matrix to form a core having a first surface and a second surface opposing the first surface of the core;

providing a projectile entry sheet and a first shock dissipation layer;

disposing the first shock dissipation layer between the projectile entry sheet and the first surface of the core;

providing a spall liner; and disposing the spall liner proximate the second surface of the core to form an armor.

19. The method, according to claim 18, further comprising the steps of:

providing a second shock dissipation layer; and disposing the second shock dissipation layer between the core and the spall liner to form the armor.

20. The method, according to claim 18, further comprising the step of:

operably associating the armor with a vehicle.

* * * * *